US005810557A

United States Patent [19]

Akinkuotu et al.

[11] Patent Number: 5,810,557

[45] Date of Patent: Sep. 22, 1998

[54] FAN WHEEL FOR AN INLINE CENTRIFUGAL FAN

[75] Inventors: Ajayi F. Akinkuotu, Plymouth; Ralph Mallwitz, Fridley, both of Minn.

[73] Assignee: The Penn Ventilation Companies, Inc., Philadelphia, Pa.

[21] Appl. No.: 792,796

[22] Filed: Jan. 3, 1997

Related U.S. Application Data

[60] Provisional application No. 60/021,950 Jul. 18, 1996.

[51] Int. Cl.[6] ..... F04D 17/08; F04D 29/30

[52] U.S. Cl. ..... 415/206; 415/208.1; 416/186 R; 416/189; 416/192

[58] Field of Search ..... 415/206, 208.1, 415/211.1, 223; 416/185, 186 R, 188, 189, 192, 223 B

[56] References Cited

U.S. PATENT DOCUMENTS

| | | | |
|---|---|---|---|
| 340,120 | 4/1886 | Hussey . | |
| 1,165,931 | 12/1915 | Akimoff . | |
| 2,054,144 | 9/1936 | Swigert . | |
| 2,117,416 | 5/1938 | Hagen . | |
| 2,360,440 | 10/1944 | Muller et al. . | |
| 3,224,078 | 12/1965 | Mayne . | |
| 3,224,079 | 12/1965 | Dybvig . | |
| 3,515,498 | 6/1970 | Tomita | 415/208.1 |
| 3,584,968 | 6/1971 | Keith | 416/186 R |
| 4,227,868 | 10/1980 | Nishikawa et al. . | |
| 4,531,890 | 7/1985 | Stokes . | |
| 4,565,495 | 1/1986 | MacLeod, Jr. . | |
| 4,647,271 | 3/1987 | Nagai et al. | 416/186 R |
| 5,171,128 | 12/1992 | Williamson et al. . | |

FOREIGN PATENT DOCUMENTS

| | | | |
|---|---|---|---|
| 338436 | 8/1920 | Germany | 416/185 |
| 707767 | 7/1941 | Germany | 415/206 |
| 61-138899 | 6/1986 | Japan | 416/188 |
| 2063365 | 6/1981 | United Kingdom | 415/206 |

*Primary Examiner*—Christopher Verdier
*Attorney, Agent, or Firm*—Patterson & Keough, P.A.

[57] ABSTRACT

An inline fan wheel is disposed within a conduit for accelerating a flow in the conduit. The fan wheel has a backplate assembly. The backplate assembly has a backplate, presenting a substantially circular outer margin, and has a centrally disposed hub that is operably coupled to the backplate. The hub has a central bore defined therein. The bore is for sliding engagement with the axial shaft. A plurality of fan blades are radially equiangularly disposed with respect to the hub and are fixedly coupled to the backplate of the backplate assembly. Each of the plurality of fan blades has a generally rectangular planform and presents a leading edge, an opposed trailing edge and first and second side margins extending between the leading edge and the opposed trailing edge, the leading edge of each of the plurality of fan blades defining an acute included angle with the longitudinal axis of the conduit. A shroud defines a flow inlet that is operably coupled to and supported by the plurality of fan blades.

21 Claims, 5 Drawing Sheets

FAN WHEEL FOR AN INLINE CENTRIFUGAL FAN

FIELD OF THE INVENTION

This application claims the benefit of U.S. Provisional Application No. 60/021,950 filed Jul. 18, 1996, and priority to which is claimed under 35 U.S.C. § 119(e).

The present invention relates to centrifugal fans. In particular, the present invention is a fan wheel providing improved flow when used in an inline centrifugal fan.

BACKGROUND OF THE INVENTION

Centrifugal fans are not new. A typical centrifugal fan wheel is used to intake air parallel to the center axis of the fan and to accelerate air radially from the center axis, causing the air to change direction ninety degrees. The center axis is the axis of rotation of the centrifugal fan. Centrifugal fans typically operate in a scroll-type housing to direct the radial air flow into a specific direction that is transverse to the center axis. These scroll type housings are very large and not conveniently adaptable to the small spaces typically allotted to air handling equipment. An advantage of centrifugal fans is that such a design is capable of efficiently generating substantial pressure in the accelerated flow.

The principal feature which distinguishes one type of centrifugal fan from another is the inclination of the blades. The three principal types of centrifugal fans are the forward curved blade fan, the backward inclined blade fan with plate blades and the backward inclined blade fan incorporating an airfoil shaped blade design. The fan blades are typically rectangular in planform and have a leading edge and a substantially parallel trailing edge. The leading edge is disposed in a parallel relationship with the axis of rotation of the centrifugal fan. The flow is accelerated parallel to the chord of the blade and is exhausted in a direction that is transverse to the axis of rotation.

The inline use of fans is to accelerate flow, principally the flow of air, in a tube or conduit. Axial fans are commonly known to be used in such application. A typical axial fan is used to move air in a linear motion substantially parallel to the axis of rotation. The axial fan wheel is typically placed in a tubular housing that allows the air to flow linearly through the tube. Axial fans have the advantage that they are capable of moving substantial volume of air. Axial fans do not have the efficiency of centrifugal fans in generating high pressure.

It is also known to use a centrifugal fan in an inline application in a conduit to provide straightline flow, especially where high pressure is desired. This provides the benefit of utilizing the more efficient centrifugal fan wheel and at the same time, disposing the centrifugal fan in the conduit is more space efficient as compared with using the large scroll housing typically used with the centrifugal fan.

There is a tradeoff in the inline application of centrifugal fans, however. Known centrifugal fans in the inline application have the drawback of operating at diminished efficiency as compared to use with a scroll housing due to the fact that known centrifugal fan wheels accelerate the flow radially. This direction of flow is transverse to the direction of flow in the conduit and is directly into the conduit wall. The flow is then forced to execute a second ninety degree turn down the conduit, simply because the flow has nowhere else to go. Flow of this type is both noisy and less than fully efficient.

U.S. Pat. No. 5,171,128 attempts to deal with the aforementioned tradeoff. The configuration of the inline fan is conventional. The fan blades are rectangular in planform. The leading edge of each of the fan blades is disposed in a parallel relationship with the axis of rotation of the centrifugal fan. The backplate of the fan, however, is notched near the trailing edges of the blades to permit a portion of the flow to be exhausted through the notches.

Fans that incorporate a conical design for exhausting the flow into a plenum, as distinct from an inline application, are known. In the plenum application, neither the intake flow nor the exhaust flow are restricted by a conduit wall. Such fans are as described in U.S. Pat. No. 2,054,144.

Notwithstanding previous efforts to increase efficiency of inline centrifugal fans, there is a continued need for an improved centrifugal fan that increases the efficiency of such devices in inline applications. The need is especially urgent in view of the environmental requirements of substantially reduced noise and reduced power required to effect the desired flow acceleration.

SUMMARY OF THE INVENTION

The present invention provides an improved inline centrifugal fan capable of accelerating a flow at an acute included angle with respect to the axis of rotation, rather than transverse to the axis of rotation. This feature greatly reduces the noise generated in the conduit as a result of accelerating the flow. It also increases the efficiency of the acceleration, such that substantially reduced input electrical power is required, thus resulting in a positive environmental effect. For fans operating in certain regions of the static efficiency curve, that the payback for replacement of existing fans with fans made according to the present invention could occur in less than three years.

The present invention is an inline fan wheel disposed within a conduit for accelerating a flow in the conduit. The inline fan wheel is mounted on a centrally disposed axial shaft which is coincident with the longitudinal axis of the conduit. The axial shaft is rotationally coupled to a prime mover and is rotationally driven thereby, the rotation being about the longitudinal axis of the axial shaft. The fan wheel comprises a backplate assembly, having a backplate presenting a substantially circular outer margin, and having a centrally disposed hub being operably coupled to the backplate. The hub has a central bore defined therein, the bore for sliding engagement with the axial shaft. The hub is rotationally driven thereby. A plurality of fan blades are circumferentially, equiangularly disposed with respect to the hub and are fixedly coupled to the backplate of the backplate assembly. Each of the plurality of fan blades has a generally rectangular planform and presents a leading edge, an opposed trailing edge and first and second side margins extending between the leading edge and the opposed trailing edge, the leading edge of each of the plurality of fan blades defining an acute included angle with the longitudinal axis of the axial shaft. A shroud defines a flow inlet that is operably coupled to and supported by the plurality of fan blades.

BRIEF DESCRIPTION OF THE DRAWINGS

FIG. 8 is a graph comparing the static efficiency performance of known fan configurations and a fan made according to the present invention;

DETAILED DESCRIPTION OF THE DRAWINGS

Figure 1:
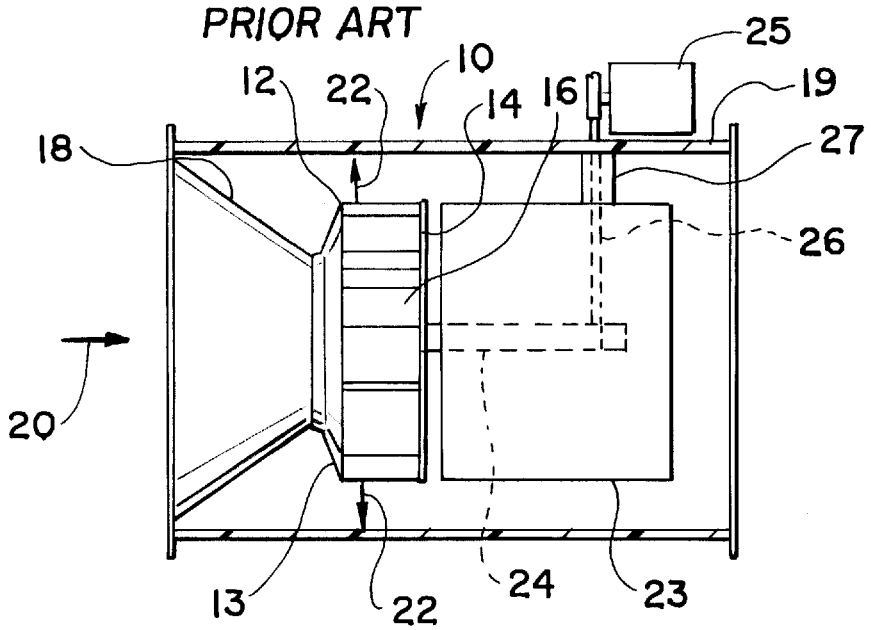
Fig. 1 PRIOR ART
FIG. 1 is a side-elevational, partially sectional view of a known prior art centrifugal fan.
Figure 2:
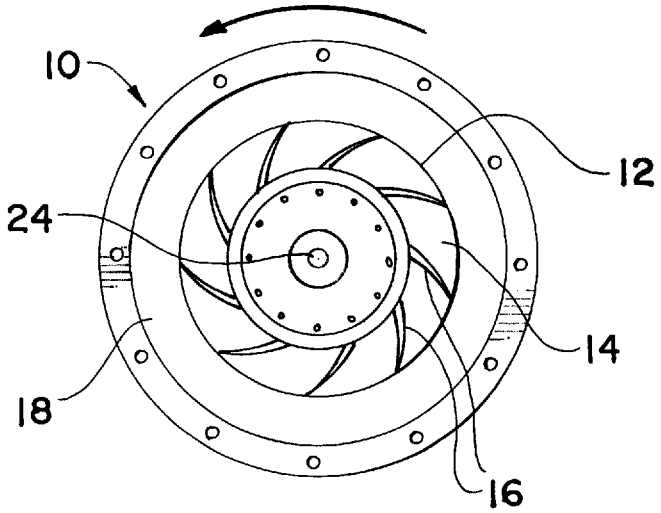
Fig. 2 PRIOR ART
FIG. 2 is a front-elevational view of the known prior art centrifugal fan of FIG. 1.
Figure 3:
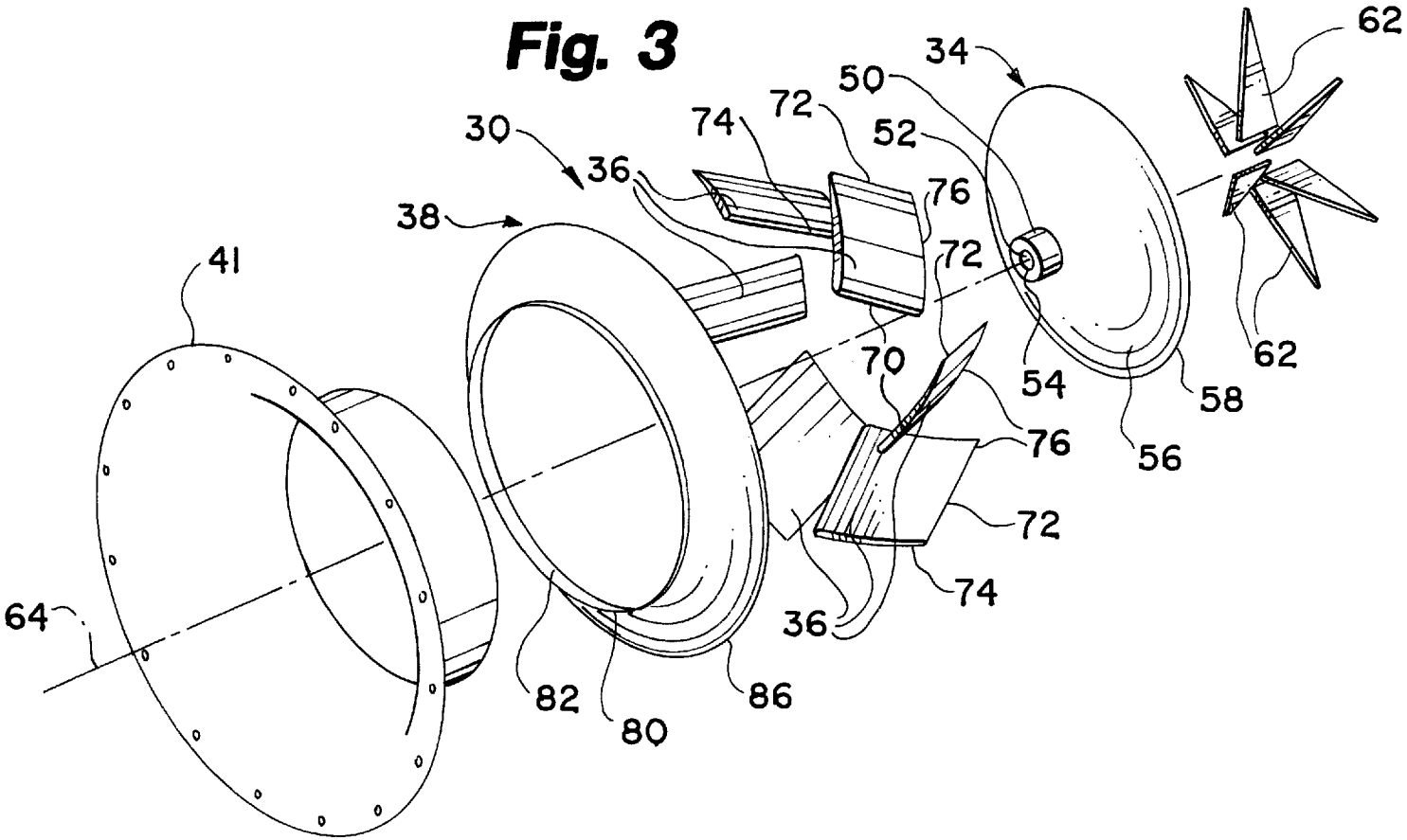
FIG. 3 is a front quarter perspective view of the centrifugal fan according to the present invention.
Figure 4:
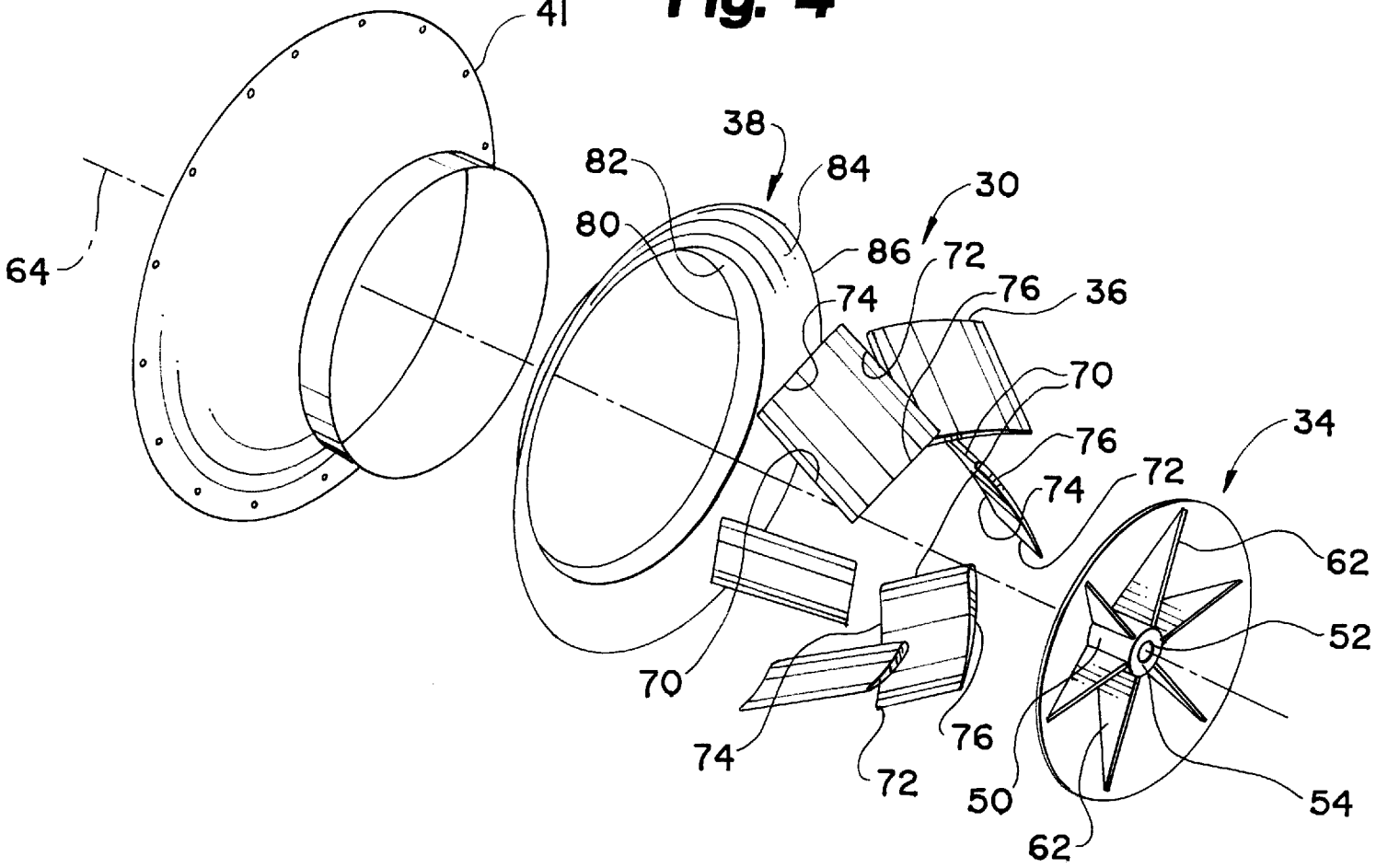
FIG. 4 is a rear quarter perspective view of the centrifugal fan.

FIGS. 1 and 2 illustrate a known prior art inline centrifugal fan 10. The prior art fan 10 includes a shroud 12, a back plate 14 and blades 16. Fan 10 is illustrated connected to an inlet funnel 18. Fan 10 and inlet funnel 18 are housed inside of tubular member 19. As illustrated, air enters inlet funnel 18 as indicated by arrow 20 and is discharged as indicated by arrows 22. As can be seen in FIG. 1, the air discharged from fan 10 will strike tubular member 19 in a radial direction due to the direction of discharge from the fan 10. The air then has nowhere else to go but to change direction and flow out the back end of tubular member 19.

The air passes around a bearing tube 23. The diameter of the fan inlet opening 13 of the shroud 12, the diameter of the backplate 14 and the diameter of the bearing tube 23 are conventionally equal. The fan 10 is supported in an overhung manner on a rotatable shaft 24. The rotatable shaft 24 is supported in bearings (not shown) disposed in the bearing tube 23. A typical electric motor 25 is depicted mounted on the conduit 19. The rotatable shaft 24 is driven by a belt 26 that passes through a belt tube 27 to rotationally engage the rotatable shaft 24. It is understood that other configurations of a drive for the rotatable shaft 24 are known.

The fan of the present invention is illustrated generally at 30 in FIGS. 3–7. The improved fan 30 is comprised of three major components: backplate assembly 34, blades 36, and shroud 38.

Figure 5:
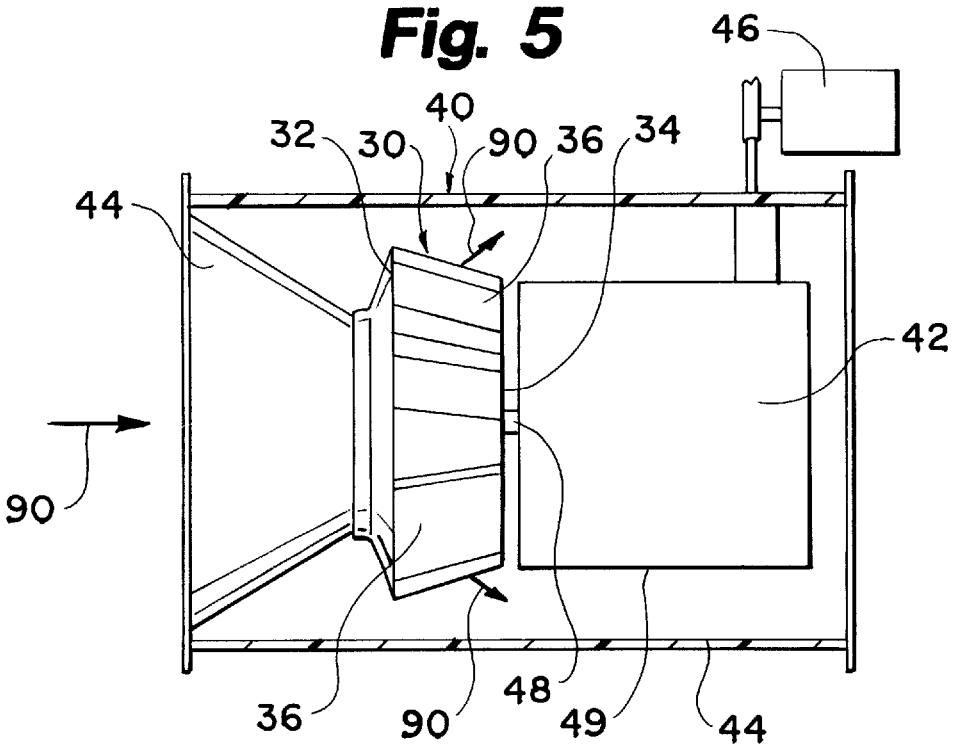
FIG. 5 is a side-elevational, partially sectional view of the fan.
Figure 6:
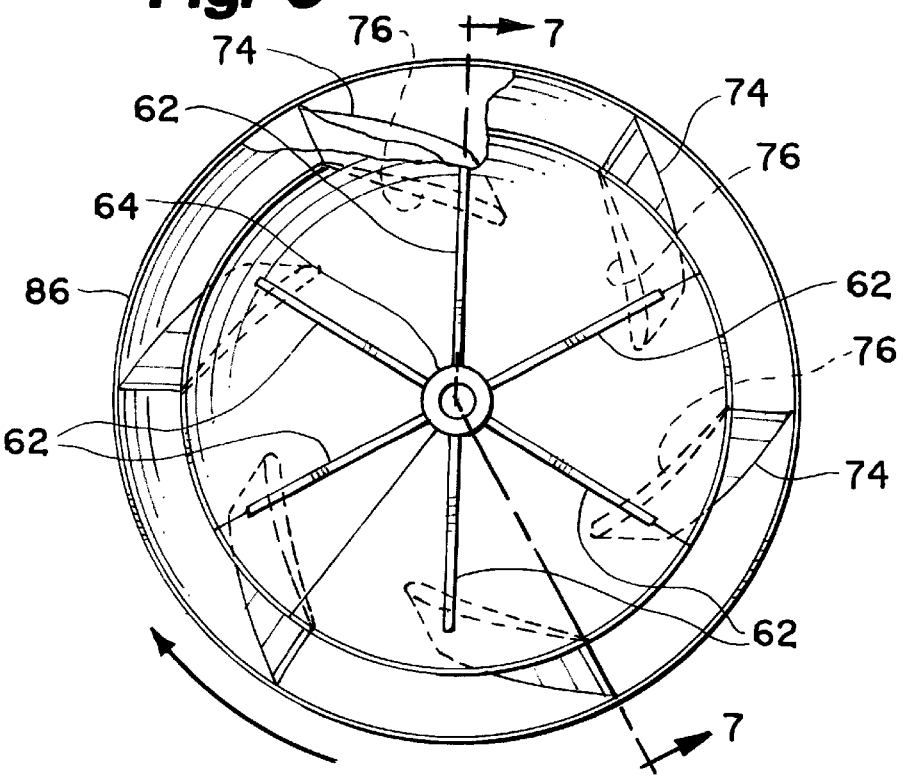
FIG. 6 is a rear elevational view of the fan with a portion of the backplate broken away to show the blade and a portion of the blades depicted in phantom.

Referring to FIG. 5, an improved fan unit 40 is depicted. The improved fan 30 is depicted mounted in the improved fan unit 40 between an inlet funnel 41 and a bearing tube 42. The inlet funnel 41 and the bearing tube 42 are fixedly supported within a conduit 44. A conventional drive unit 46 is provided to rotationally power the improved fan 30 by means of a rotatable shaft 48 that projects forward from the bearing tube 42. A flow passageway is defined between the exterior of the housing 49 of the bearing tube 42 and the interior surface of the conduit 44 Referring to FIGS. 3–7, the backplate assembly 34 has a hub 50. The hub 50 has an axial bore 52 defined therein. The axial bore 52 is designed to receive the rotatable shaft 48 therein. A key slot 54 is provided in the axial bore 52 to receive a key (not shown) that rotationally couples the improved fan 30 to the rotatable shaft 48.

A backplate 56 is fixedly coupled to the hub 50 preferably by means of weldments. The backplate 56 has an outer margin 58 that is circular in shape. In a preferred embodiment, the backplate 56 has a conical shape 60 with the frustum of the cone lying between parallel planes defined by the outer margin 58 and the point of fixation of the backplate 56 to the hub 50. Preferably, a plurality of generally triangular shaped stiffeners 62 have a first side welded to the downstream side of the backplate 56 and a second side welded to the hub 50.

Figure 7:
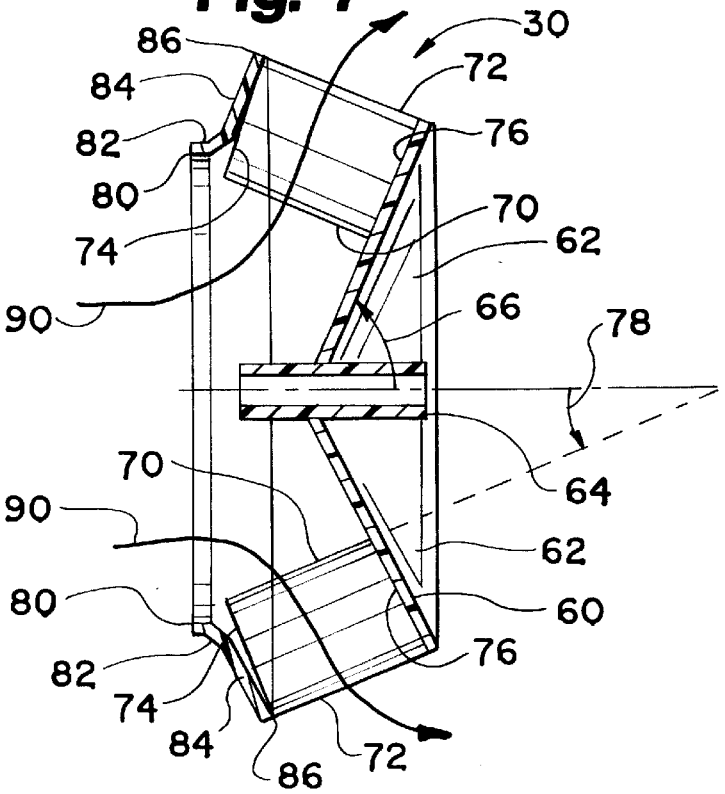
FIG. 7 is a sectional view of the fan taken along the line 7—7 of FIG. 8.

In the preferred conical configuration of backplate 56, the backplate 56 defines an acute included angle with the center axis 64 of the hub 50 and with the rotatable shaft 48. This relationship is best depicted in FIG. 7. The acute included angle is depicted at 66. Angle 66 is preferably between forty and eighty degrees. Particularly efficient results have been shown to occur when the angle 66 is substantially sixty-seven degrees.

A plurality of blades 36 are fixedly coupled to the forward upstream face of the backplate 56. The blades 36 are radially disposed with respect to the hub 50 in an equiangular disposition about the backplate and spaced apart from the hub 50. The preferred configuration of the improved fan 30 is with six blades 36, although a lesser or greater number of blades 36 could also be used in the range of five to eight blades.

The blades 36 are generally rectangular in plan form. For relatively large applications of the improved fan 30, such as forty to ninety inches in diameter, the blades 36 are formed in the shape of an airfoil, having an upper and lower surface with the upper surface having a longer span than the lower surface from the leading edge 70 to the trailing edge 72. For smaller applications of the improved fan 30, the blades 36 are preferably flat plates.

Each of the blades 36 has a leading edge 70 and a generally parallel trailing edge 72. The leading edge 70 and the trailing edge 72 are connected by two generally parallel side margins, the forward side margin 74 and the rear side margin 76. The rear side margin 76 of the blade 36 is preferably welded at its full dimension to the backplate 56.

The leading edge 70 of the blades 36 define an acute included angle with the center axis 64 of the hub 50. The angle is preferably between ten degrees and fifty degrees, more preferably ten degrees and thirty degrees.

As depicted in FIG. 5, the shroud 38 is positioned rearward of and slightly spaced apart from the inlet funnel 41 so that there is no interference between the rotating shroud 38 and the stationary inlet funnel 41. The shroud 38 has a shroud intake 80. The shroud intake 80 is in flow communication with the inlet funnel 41 for receiving flow therefrom.

The shroud 38 has a curved shroud wall 82 extending rearward from the shroud intake 80 in the downstream direction as depicted in FIG. 7. The curved shroud wall 82 has a generally expanding diameter.

The curved shroud wall 82 leads into the straight shroud wall 84. As depicted in FIG. 7, straight shroud wall 84 is generally parallel with the backplate 56. The shroud 38 is preferably welded to and supported by each of the blades 36. The weldment joins the portion of the forward side margin 74 of the blade 36 that is proximate the trailing edge 72 of the blade 36 to the shroud 38.

The outer margin of the straight shroud wall 84 defines the fan inlet opening 86. As depicted in FIGS. 5 and 7, the diameter of the fan inlet opening 86 is substantially greater than the diameter of the outer margin 58 of the backplate 56. For a comparably sized improved fan 30 as compared to the prior art fan 10, a substantially larger area fan inlet opening 86 is utilized. This is a result of the angular disposition of the blades 36 with respect to the center axis 64. An additional effect of this angular disposition of the blades 36 in the improved fan unit 40 results from the fact that the diameter of the bearing tube 42 utilized with the improved fan 30 has a substantially decreased diameter as compared to the bearing tube 23 of the prior art fan 10. This reduced diameter bearing tube 42 has the effect of resulting in an increased area of the flow passageway defined between the outside surface of the bearing tube 42 and the inside surface of the conduit 44, thus facilitating a greater flow therein.

Flow, as depicted by arrows 90 in FIGS. 5 and 7 enters the inlet funnel 41 and flows into the shroud intake 80. The flow through the improved fan 30 is substantially conical. The flow makes a first turn through an obtuse angle to flow across the plurality of fan blades 36. The flow is accelerated by the rotating improved fan 30 cordwise across the upper surface of the blades 36. A cord is defined as a straight line connecting the leading edge 70 and the trailing edge 72 of the blade 36. The accelerated flow 90 is exhausted from the trailing edge 72 of the blade 36, makes a second turn through an obtuse angle and flows in the passageway defined between the reduced-size bearing tube 42 and the conduit 44.

The advantages of the present invention as compared to existing inline centrifugal fans is demonstrated by the test results depicted in FIG. 8. The graph is of the static efficiency at particular performance points, PT1–PT7. The performance points are defined as follows:

| | Flow Rate | Static Pressure |
|---|---|---|
| PT1 | 10,000 CFM | 5.0 psig |
| PT2 | 11,000 CFM | 4.0 psig |
| PT3 | 13,000 CFM | 3.5 psig |
| PT4 | 15,000 CFM | 3.0 psig |
| PT5 | 14,500 CFM | 2.0 psig |
| PT6 | 14,500 CFM | 1.0 psig |
| PT7 | 14,500 CFM | 0.5 psig |

In the graph of FIG. 8, static efficiency is expressed as a percent. The performance of the improved fan of the present invention is represented by the curve +. The existing centrifugal fans are represented by the curves □, ○, Δ, and ⓧ. It should be noted that the efficiencies of the present invention as compared to the existing fans are most dramatic in the right hand portion of the graph that is generally characterized as high rate of flow at low pressure. In this arena, the inline fan of the present invention is approximately twice as efficient as existing inline centrifugal fans. Such a dramatic increase in efficiency makes it attractive to replace existing inline centrifugal fans with the fan of the present invention. The payback for such replacement could occur in as little as three years of operation. This translates into a substantial positive environmental effect, as the electrical power required to perform the same work is greatly reduced. Substantially reduced horsepower prime movers can be utilized to perform the same work. Being of reduced size, such prime movers represent a reduced initial cost, as well as the ongoing savings in electrical power consumed.

Although the present invention has been described with reference to a preferred embodiment, workers skilled in the art will recognize that changes may be made in form and detail without departing from the spirit and scope of the invention.

What is claimed is:

1. An inline fan wheel disposed within a conduit for accelerating a flow in the conduit, the inline fan wheel being mounted on a centrally disposed axial shaft, the axial shaft being coincident with the longitudinal axis of the conduit and being rotationally coupled to a prime mover for being rotationally driven thereby, said rotation being about the longitudinal axis of said axial shaft, the fan wheel comprising:

a backplate assembly, having a backplate presenting a substantially circular outer margin, and having a centrally disposed hub, the hub being operably coupled to the backplate, the hub being in operable engagement with the axial shaft for being rotationally driven thereby;

a plurality of fan blades circumferentially, equiangularly disposed with respect to the hub, each of the plurality of fan blades having a generally rectangular planform and presenting a leading edge, an opposed trailing edge and first and second side margins extending between the leading edge and the opposed trailing edge, the leading edge and trailing edge of each of the plurality of fan blades each defining an acute included angle of between thirty degrees and ten degrees with the longitudinal axis of the axial shaft, each of the plurality of fan blades being fixedly coupled to the backplate of the backplate assembly at the first side margin thereof; and an inlet shroud defining a substantially circular flow inlet and being operably coupled to and supported by the plurality of fan blades at the second side margin thereof;

wherein the fan wheel is capable of achieving a static efficiency of about seventy percent at a flow rate in the conduit of about fifteen thousand cubic feet per minute.

2. The inline fan wheel of claim 1 having five to eight fan blades.

3. The inline fan wheel of claim 2 having six fan blades.

4. The inline fan wheel of claim 1 wherein the acute included angle defined by the leading edge and the trailing edge of each of the plurality of fan blades with the longitudinal axis of the axial shaft is less than thirty and more than ten degrees.

5. The inline fan wheel of claim 4 wherein the acute included angle defined by the leading edge and the trailing edge of each of the plurality of fan blades with the longitudinal axis of the axial shaft is substantially twenty-three degrees.

6. The inline fan wheel of claim 1 wherein the diameter of the outer margin of the backplate assembly is less than the diameter of the flow inlet of the inlet shroud.

7. The inline fan wheel of claim 1 wherein each of the plurality of fan blades defines an airfoil shape.

8. The inline fan wheel of claim 1 wherein the inlet shroud has a first curved portion and a second straight portion, the straight portion being substantially parallel to and spaced apart from the backplate of the backplate assembly.

9. The inline fan wheel of claim 8 wherein the inlet shroud is fixedly coupled to the second side margin of the each of the plurality of fan blades at the straight portion of the inlet shroud.

10. The inline fan wheel of claim 1 wherein the flow in the conduit is caused to turn through two obtuse angles during acceleration by the fan blades.

11. An inline fan unit, comprising:

a conduit defining an interior flow channel and having a longitudinal axis;

an inlet funnel disposed in the interior flow channel, being fixedly coupled to the conduit and having an upstream flow inlet and a downstream flow outlet;

an inline fan having a backplate assembly, a plurality of fan blades, and an inlet shroud, the backplate assembly having a backplate presenting a substantially circular outer margin, and having a centrally disposed hub being operably coupled to the backplate, the plurality of fan blades being radially, equiangularly disposed with respect to the conduit longitudinal axis and being fixedly coupled to the backplate of the backplate assembly, each of the plurality of fan blades having a generally rectangular planform and presenting a leading edge, an opposed trailing edge and first and second side margins extending between the leading edge and the opposed trailing edge, the leading edge of each of the plurality of fan blades defining an acute included angle of between thirty degrees and ten degrees with the longitudinal axis of the conduit, and the inlet shroud defining a flow inlet, the flow inlet being in flow communication with the downstream flow outlet of the inlet funnel, the shroud being operably coupled to and supported by the plurality of fan blades for rotation therewith; and a bearing tube, being fixedly coupled to the conduit and disposed spaced apart and downstream from the inline fan in the conduit interior flow channel, the bearing tube having a diameter that is substantially equal to the diameter of the circular outer margin of the backplate assembly;

wherein the inline fan is capable of achieving a static efficiency of about seventy percent at a flow rate in the conduit of about fifteen thousand cubic feet per minute.

12. The inline fan unit of claim 11 having five to eight fan blades.

13. The inline fan unit of claim 12 having six fan blades.

14. The inline fan unit of claim 11 wherein the acute included angle defined by the leading edge and the trailing edge of each of the plurality of fan blades with the longitudinal axis of the axial shaft is less than thirty and more than ten degrees.

15. The inline fan unit of claim 14 wherein the acute included angle defined by the leading edge and the trailing edge of each of the plurality of fan blades with the longitudinal axis of the axial shaft is substantially twenty-three degrees.

16. The inline fan unit of claim 11 wherein the diameter of the outer margin of the backplate assembly is less than the diameter of the flow inlet of the inlet shroud.

17. The inline fan unit of claim 11 wherein each of the plurality of fan blades defines an airfoil shape.

18. The inline fan unit of claim 11 wherein the inlet shroud has a first curved portion and a second straight portion, the straight portion being substantially parallel to and spaced apart from the backplate of the backplate assembly.

19. The inline fan unit of claim 18 wherein the inlet shroud is fixedly coupled to each of the plurality of fan blades at the straight portion of the inlet shroud.

20. The inline fan unit of claim 11 wherein the flow in the conduit is caused to turn through two obtuse angles during acceleration by the fan blades.

21. A method of accelerating a flow in a conduit, the conduit having a longitudinal axis and an inner conduit wall defining a flow channel therein, comprising the steps of:

rotating a fan disposed inline within the conduit about a hub axis, the hub axis being substantially coincident with the longitudinal axis of the conduit;

providing a conical flow path through the fan, the conical flow path having a plurality of fan blades disposed therein, the plurality of fan blades having a generally rectangular planform and being radially displaced from the hub axis, each of the plurality of fan blades having a chord dimension, the chord defining an acute included angle with the conduit longitudinal axis;

accelerating the flow across the plurality of fan blades in a direction substantially parallel to the chord of each of the plurality of fan blades; and exhausting the accelerated flow from the rotating fan in a direction that is substantially parallel to the chord of each of the plurality of fan blades and at an included angle that is less than thirty degrees and more than ten degrees with respect to the inner conduit wall;

wherein the fan is capable of achieving a static efficiency of about seventy percent at a flow rate in the conduit of about fifteen thousand cubic feet per minute.

* * * * *